United States Patent [19]

Gutridge et al.

[11] 4,047,488

[45] Sept. 13, 1977

[54] TABLE ARRANGEMENT FOR RAILWAY PASSENGER CAR COMPARTMENTS

[75] Inventors: Jack E. Gutridge, Dyer; Ronald W. Marsh, Michigan City, both of Ind.; Grant M. Newbury, Shawano, Wis.

[73] Assignee: Pullman Incorporated, Chicago, Ill.

[21] Appl. No.: 720,021

[22] Filed: Sept. 2, 1976

[51] Int. Cl.[2] ..... B61D 1/02

[52] U.S. Cl. ..... 105/315; 105/329 R; 108/48

[58] Field of Search ..... 105/314, 315, 327, 329 R, 105/344, 345; 108/48, 134, 135; 248/240, 240.1, 240.2, 240.3, 240.4, 250; 312/241, 281, 282, 314, 316

[56] References Cited

U.S. PATENT DOCUMENTS

| | | | |
|---|---|---|---|
| 20,777 | 7/1858 | Cobb | 105/327 |
| 827,237 | 7/1906 | Hofacker | 108/135 |
| 2,226,735 | 12/1940 | Miller et al. | 108/48 X |
| 2,483,899 | 10/1949 | Grasso et al. | 108/134 |
| 3,394,666 | 7/1968 | Pearlman | 108/135 X |

FOREIGN PATENT DOCUMENTS

| | | | |
|---|---|---|---|
| 463,360 | 4/1951 | Italy | 108/134 |

*Primary Examiner*—Albert J. Makay
*Assistant Examiner*—Randolph A. Reese
*Attorney, Agent, or Firm*—Richard J. Myers

[57] ABSTRACT

A table arrangement for a railway passenger car compartment includes a first table which can be folded from a use to a stored position in a side of the compartment. The first table can be used alone or it can be joined for use with a larger knock-down table which includes latching provisions for interlocking the two table tops of the arrangement.

10 Claims, 8 Drawing Figures

TABLE ARRANGEMENT FOR RAILWAY PASSENGER CAR COMPARTMENTS

This application relates to co-pending application Ser. No. 720,020 filed Sept. 2, 1976.

BACKGROUND OF THE INVENTION

Field of the Invention

This invention relates to a table arrangement for use in a railway passenger car. More specifically the invention relates to collapsible tables wherein a smaller table is used to support the table top of a larger table and has inter-engaging releasable latch means for securing the tables in jointed position.

Description of the Prior Art

Folding tables of the collapsible or knockdown type which may be recessed against or into wall structures are shown in U.S. Pat. Nos. 859,454, July 9, 1907; 1,984,602, Dec. 18, 1934; 2,483,899, Oct. 4, 1949; and 3,113,533, Dec. 10, 1963.

The present invention is an improvement over the prior art in that it provides for a small knock-down table having inter-locking provisions with a larger table and table top so that the smaller table can be interlocked with the larger table if desired wherein the top of the larger table is then placed in use.

SUMMARY OF THE INVENTION

A passenger car compartment which includes pairs of convertible seat structures facing each other which in the seating position provide a space therebetween also includes a knock-down or collapsible folding table which in a non-use position is stored in a side wall of the compartment. The table can be easily removed to a use position wherein a passenger on one of the seats will have the table top available for use. Another table of larger size having a folding leg structure is supported on one of the walls of the compartment in a non-use position and can easily be removed therefrom. The larger table includes a folding leg structure and a large table top which can be connected to the top of the table top of the smaller table by releasable latch means so that the smaller table now supports the larger table at one end thereof with the folding legs of the larger table supporting the other end of the table of the larger table top. Thus, the larger table top is now available for use as desired by the passenger or passengers within the compartment. The latching mechanism is such that the larger top can quickly be secured to the smaller table top and be removed therefrom. The smaller table includes a folding leg structure of jacknife construction, which also can quickly be actuated by a latching mechanism so that the table can be moved between use and stored positions within the recess or pocket of one of the walls of the compartment.

DESCRIPTION OF THE PREFERRED EMBODIMENT

Figure 2:
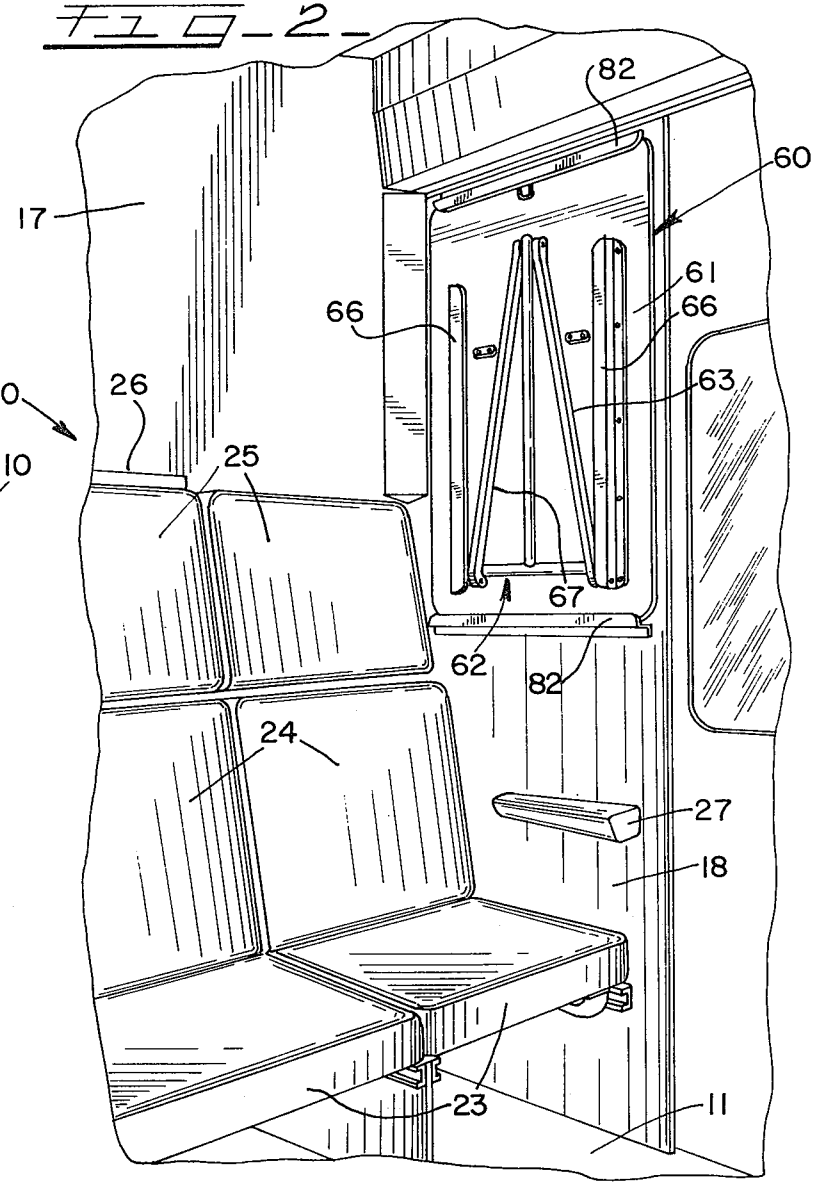
FIG. 2 is a view similar to FIG. 1 showing another side of the passenger car compartment.
Figure 1:
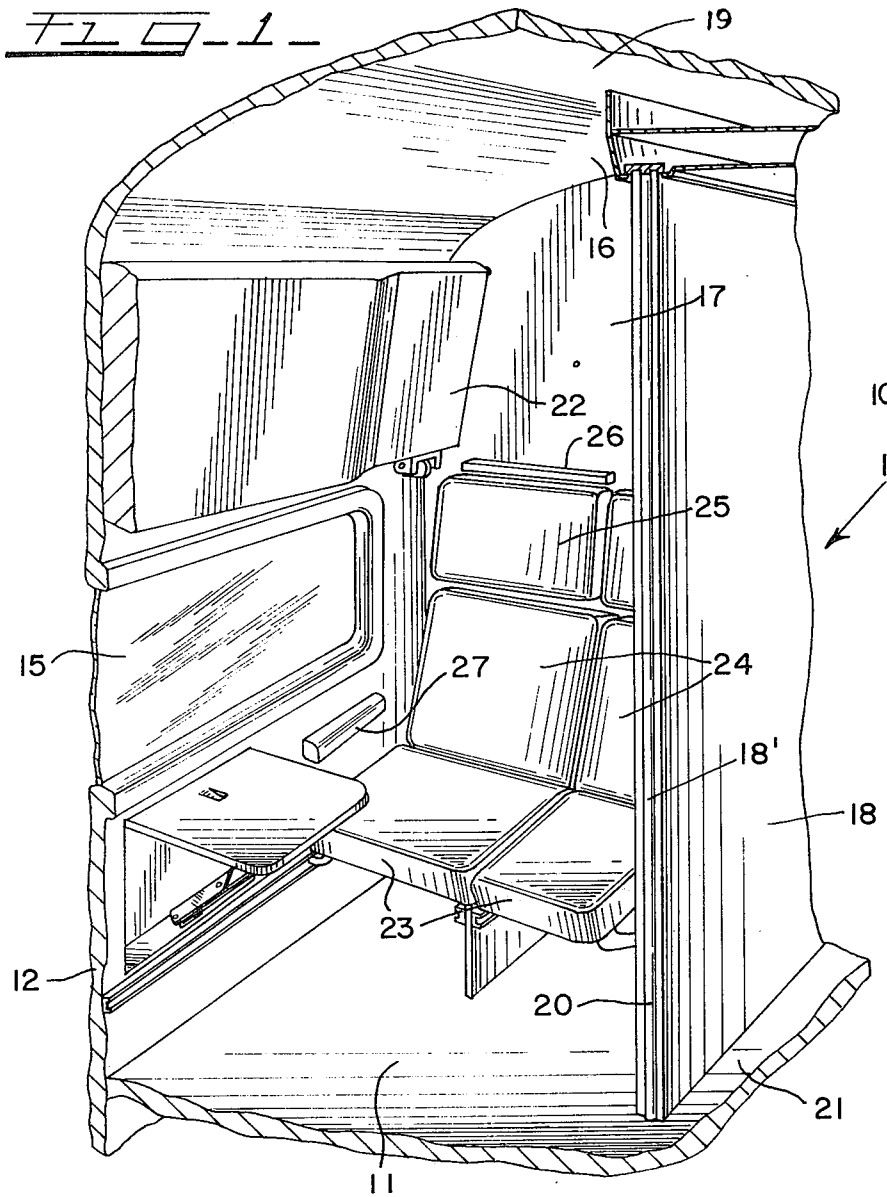
FIG. 1 is a perspective view showing approximately one-half of a railway passenger car compartment embodying the invention.

Referring now particularly to FIGS. 1 and 2, one-half portion of a railway passenger car compartment 10 is disclosed. FIG. 1 shows one outer side of the compartment 10 and FIG. 2 shows the inner side of the compartment. It is to be understood that the other half of the compartment (not shown) is substantially identical insofar as the seating arrangements and accommodations are concerned. The compartment 10 comprises an outer side wall 12 consisting of suitable spaced wall sheets 13 and 14. The outer side wall 12 includes an outer window 15 and is connected at its upper end to a roof structure 16. Each of the compartments comprises two partition walls 17, only one of which is shown. The partition walls in turn are connected to divider walls 18 which at their upper ends are suitably connected to wall support and roof structure generally designated at 19. The divider walls 18 are provided with a suitable door opening 20 which may be closed by a sliding door panel 18' disposed within the divider wall 18. In the conventional passenger car an aisle 21 may suitably separate the passenger car compartments. The compartment 10 includes an upper folding berth 22 and convertible seat structures 23 which are connected to seat backs 24 above which there are provided head rests 25 for each of the seats. Berth supports on the partition walls 17 are connected thereto above the head rests for supporting opposite ends of the upper berth. The convertible seats 23 and seat backs 24 which are provided on longitudinally spaced opposite ends of the compartment are adapted to be placed in a horizontal or reclining position to form a suitable bed structure. In the position shown in FIGS. 1 and 2, the seats are in a sitting position and a longitudinal space is provided therebetween with the seats facing each other within the compartment. Each of the seat structures also include arm rests 27 suitably supported adjacent thereto.

Figure 3:
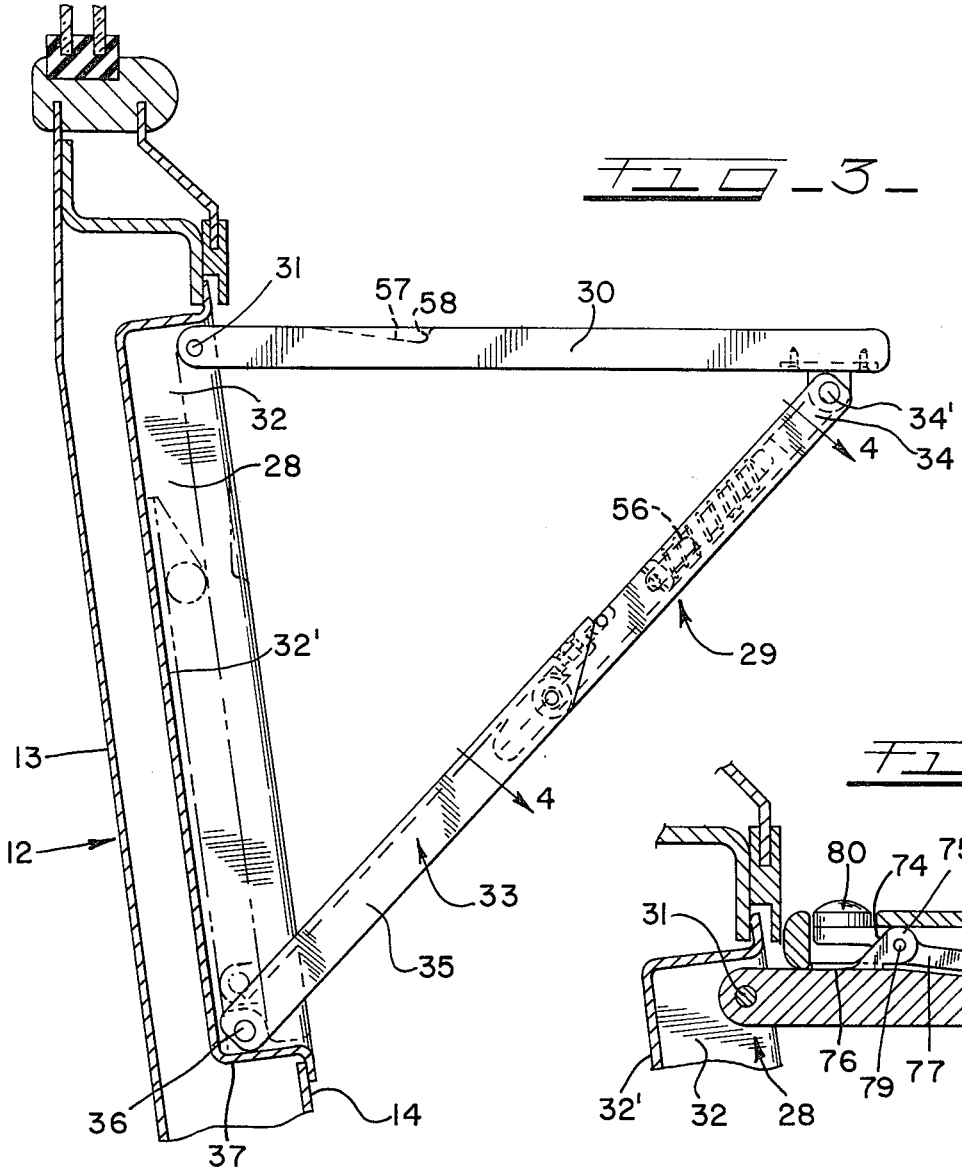
FIG. 3 is a cross-sectional view through an outer wall of a railway passenger compartment showing a collapsible table in a use or operating position.
Figure 4:
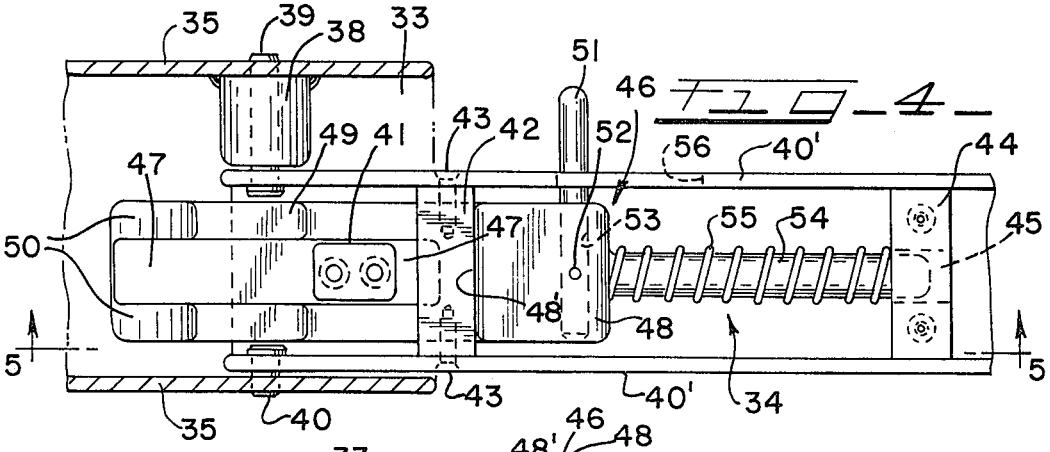
FIG. 4 is a view taken substantially along the line 4—4 of FIG. 3.
Figure 5:
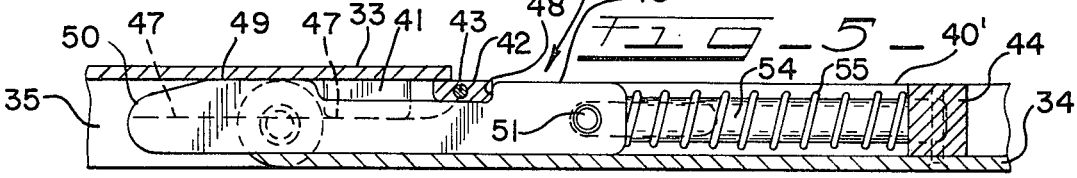
FIG. 5 is a cross-sectional view taken substantially along the line 5—5 of FIG. 4.
Figure 6:
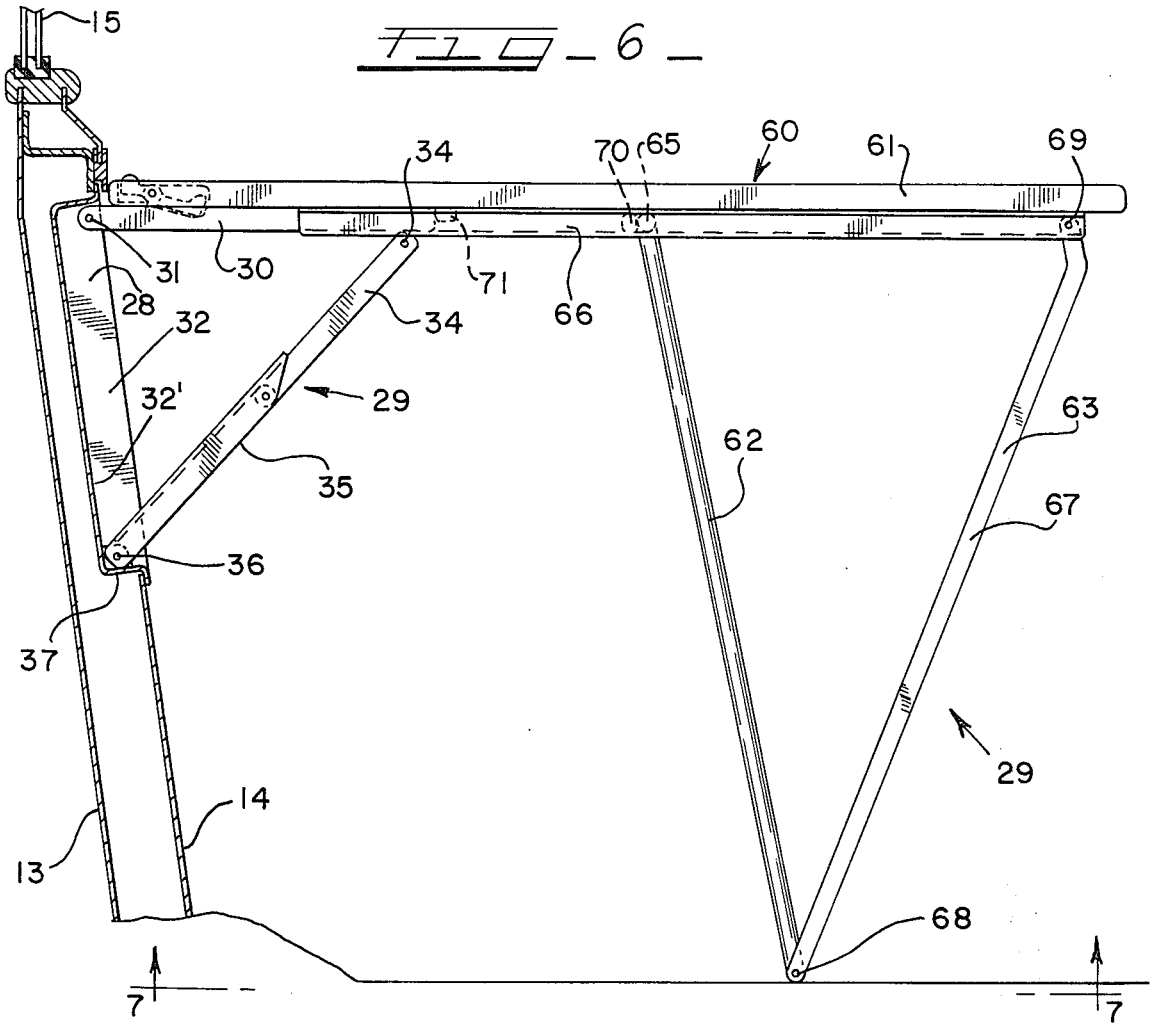
FIG. 6 is a side elevational view of a pair of tables joined together with a larger table in a used position.

As best shown in FIGS. 3 and 6, a portion of the outer side wall 12, disposed between the seating arrangement is provided with a recess or pocket structure 28 within which a small table 29 may be stored in a non-use position. The table 29 includes a flat top 30 which is hinged at 31 to side walls 32 of the pocket structure 28 which is disposed between the walls 13 and 14 of the passenger car. The pocket structure 28 also includes a rear wall 32' spaced midway between the walls 13 and 14. The small table 29 also includes a jackknife folding leg structure consisting of folding legs 33 and 34. The leg 34 is suitably connected by means of a pivot and bracket structure 34' to the underneath side of the table top 30. The folding leg 33 is of channel shaped construction including flanges 35 which are hingedly connected by means of a hinged member 36 to a hinged bracket 37 supported in a lower portion of the pocket structure 28. A spacer boss 38 is connected to one of the flanges 35 and projects inwardly with respect thereto. The boss 38 supports a hinge pin 39 and is hingedly connected to the folding leg 34. Another hinge pin 40 on the other flange 35 is also hingedly connected to the folding leg 34. The connection of the pins 39 and 40 extend through flanges 40' provided on the leg 34. As best shown in FIGS. 4 and 5 a retaining lug 41 is centrally supported on the web portion of the folding leg 33. A stop bracket 42 is rigidly secured to the flanges 40' by means of screws 43.

The leg 34 also has rigidly connected thereto at the upper end thereof a guide bracket 44 having a bore 45 extending therethrough. A latch member 46 includes a recessed portion 47 which, as best shown in FIG. 4, extends longitudinally toward one end of the latch member from one side of a raised head portion 48. As best shown in FIG. 5, the raised head portion 48 is undercut to provide an abutment 48' which is adapted to engage one side of the stop bracket 42. The latch member 46 also includes coextensive with the recessed portion upwardly projecting side portions 49 which at their outer ends include upper tapered surfaces 50. A handle 51 is secured within a bore 53 of the head portion 48 by means of a pin 52. The head 48 has connected thereto a guide rod 54 which is guided within the bore 45. A coil spring 55 in abutting relation with respect to the guide bracket 44 continually urges the head 48 and particularly the abutment 48' into locking engagement with respect to the stop bracket 42. As best shown in FIG. 4, one of the flanges 40' is provided with a slot 56 through which the handle 51 projects.

Figure 8:
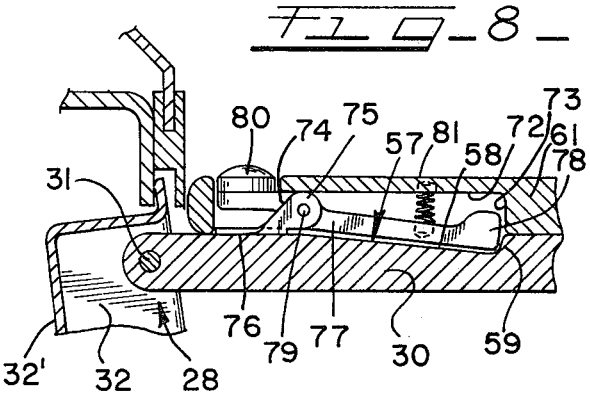
FIG. 8 is a cross-sectional view of a latch mechanism interconnecting a pair of tables.
Figure 7:
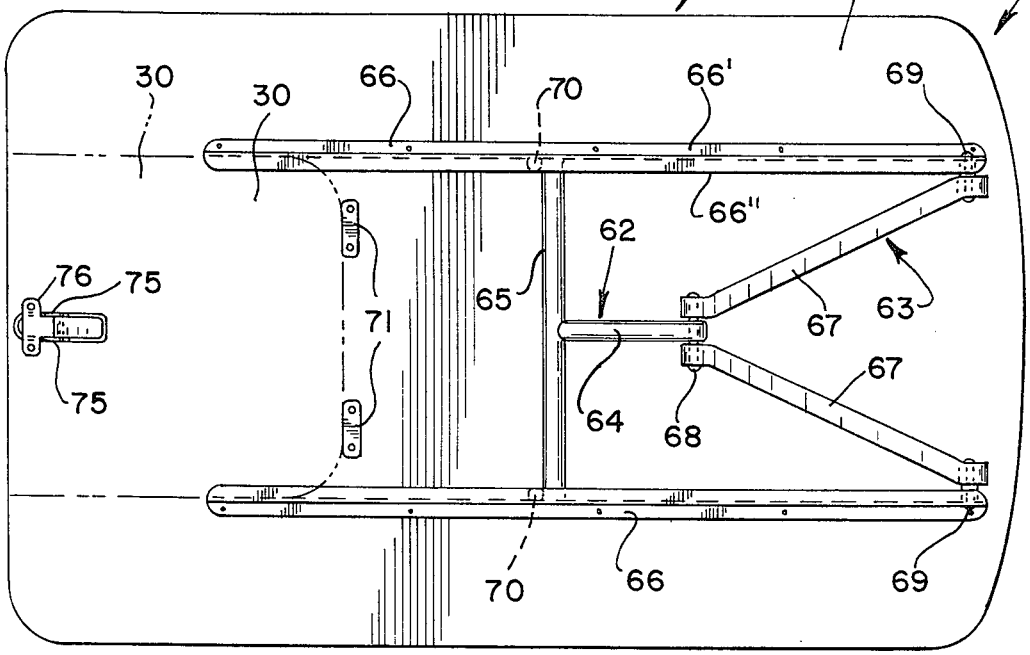
FIG. 7 is a bottom view of the table arrangement shown in FIG. 6 with the view being taken substantially along the line 7—7 thereof.

The upper surface of the table 30 is provided with a recess 57 which as shown in FIG. 8 is formed by an inclined wall 58 terminating in an abutment 59 within the table top. A second larger table is designated at 60 and includes foldable legs 62 and 63. The leg 62 is formed by means of a central tubular leg member 64 connected to a transversely extending leg portion 65 which is slidably disposed in laterally spaced Z-shaped leg guides 66. As best shown in FIG. 7, one of the flanges 66' of each leg guide 66 is connected to the underneath surface of the table top 61 with the other flange 66'' spaced therefrom and slidably being engaged by the ends of the transverse leg member 65. As best shown in FIGS. 6 and 7, in the use position the transverse leg member 65 is up against stops 70 provided in the leg guides 66. The leg arrangement 63 includes diagonal leg members 67 which are pivotally connected at their lower ends to the central leg member 64. The upper ends of the diagonal leg members 67 are suitably connected to a pivot pin and bracket arrangement 69 provided on ends of the leg guides 66. A pair of stop blocks 71 are also secured to the underneath side of the table tops 61 and when the top 61 is in engaging position wherein ends of the Z-shaped leg guides 66 are slidably moved over the smaller table top 30 as shown in FIG. 7, the stop blocks 71 engage the inner ends of the table top 30.

As best shown in FIG. 8, a top 61 includes a recess 72 and an abutment 73 complemental in size and configuration with the recess 57 of the table 30. A hinged bracket is designated at 74 and includes ears 75 connected to a flat plate 76. As best shown in FIG. 7, the flat plate 76 spans the recess 72 of the table top 61 and is rigidly connected to the underneath surface thereof. A latch lever 77 includes a head portion 78 which is adapted to engage the abutment 59 and is hingedly connected by means of a hinge pin 79 to the ears 75 of the hinge bracket 74. The latch lever 77 is thus, hinged on the bracket 74 and is actuated by means of a button 80 against the spring action of a spring 81 which as shown in FIG. 8 normally maintains the head 78 in engaging position with the abutment 59.

OPERATION

Referring now to FIG. 3, the first or small table 29 is shown in broken lines in a stored position within the pocket structure 28. The solid line position shows the table top 30 in a use position with the legs 34 and 35 being held in a linear aligned position by means of the latch member 46. The legs 34 and 35 are so rigidly held in position by means of the latch member 46 by virtue of the fact that the head portion 48 with its abutment 48' is in engagement with the stop bracket 42. The spring 55 maintains this engagement with the handle 51 at one end of the slot 56 as disclosed in FIG. 4. Thus, a passenger who may wish to use the small table now has access thereto and can readily do so. If it is desired to again place the table 29 in the stored position the passenger merely grasps hold of the handle 51 and moves the same to the right shown in FIG. 4, wherein the spring is compressed and the head abutment 48' is moved away from the stop bracket 42. The retaining latch 41 prevents the latch member 46 from protruding from the hinged leg 34 when the table is in stored position. Since the head 48 is moved sufficiently to the right a distance wherein the ends of the upwardly projecting side portions 49 and tapered surfaces 50 are moved to the right (FIGS. 4 and 5) of the pivot pins 39 and 40 the legs 33 and 34 can now be jackknifed or collapsed to a position wherein they are stored with the table top within the pocket structure 28. If it is again desired to place the table 29 in the use position, it is a simple matter to merely pull out the same whereupon the jackknife type of construction will again immediately be engaged in the linear supporting position by virtue of the latch arrangement 46 which is disclosed.

This latch arrangement is described in greater detail in the aforementioned related patent application.

Referring now particularly to FIG. 2, the table 60 is shown in a stored position with the folding legs collapsed. In this position, Z-shaped bracket slides 82 are mounted on the divider wall 18 and the ends of the table are merely slidably disposed and held in position by means of the said bracket slides 82. It is a simple operation to pull the table 60 outwardly from the support and to place the legs 62 and 63 in the position shown in FIGS. 6 and 7. The larger table 61 is now moved over the top of the table top 30 with the sides of the top 30 being engaged by the ends of the leg guides 66 until the stop brackets 71 engage the outer end of the top 30 as best shown in FIG. 7. The latch 77 is now urged into the engaging position shown in FIG. 8, with respect to the table top 30, so that the top 61 of the second table is now firmly supported at one end of the smaller table. Thus, the passengers within the compartment may now have use of the larger table which can also very quickly be disassembled and again returned to the position shown in FIG. 2. The operator merely need push downwardly on the button 80 thus removing the head 78 from the engaging position shown in FIG. 8 with respect of the abutment 59 whereupon the larger table can then be pulled outwardly and disengage from the smaller table and the folding leg structure can again be collapsed as desired.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A passenger compartment for a railway car formed by an outer side wall, longitudinally spaced and laterally extending partition walls, and a divider wall extending longitudinally and having a door opening providing access to said compartment, a passenger seat positioned against each partition wall and extending laterally therewith, the improvement including;

a table arrangement adapted to be positioned in use position between said seats comprising;

a first table supported on said first outer side wall in a flat upright stored position, means supporting said first table on said outer wall whereby the same may be moved to a horizontal use position, means releasably locking said table in said use position, a second table including means releasably connecting the same to one of said walls in an upright stored position, said second table including a table top having connector means, said second table being movable to a horizontal use position whereby said connector means engages said first table to connect said tables together with said first table serving as a support means for said second table top, and said connector means including releasable latch means for releasably locking said tables in said use position.

2. The invention in accordance with claim 1, and said outer side wall including a recess, and said first table being stored in said recess.

3. The invention in accordance with claim 2, and said first table being hingedly mounted within said recess.

4. The invention in accordance with claim 3, and said means releasably locking said first table in said use position including a jackknife linkage arrangement having one link pivotally connected to said outer side wall and another link pivotally connected to said first table.

5. The invention in accordance with claim 4, and said linkage arrangement including a spring biased latch mechanism.

6. The invention in accordance with claim 1, and said connector means including a pair of guide members connected to the underneath side of said table tops, said guide members having flanges slidingly engageable with opposite edges of said first table to secure said tables in use position.

7. The invention in accordance with claim 6, and said connector means further including a releasable latch interconnecting said first and second tables.

8. The invention in accordance with claim 7, and said latch including a spring biased stop element in the underneath surface of said table top, and said first table including a second table top having a recess including an abutment, said recess receiving said stop element and engaging said abutment in interlocking relation.

9. The invention in accordance with claim 1, and said means releasably connecting said table to one of said walls including a pair of horizontal flanged elements mounted on one of said walls, said elements engaging opposite edges of said table top in slidingly securing relation.

10. The invention in accordance with claim 1, and said table including a folding leg arrangement adapted to provide additional support means for said table top.

* * * * *